United States Patent [19]

Torii et al.

[11] 4,262,647

[45] Apr. 21, 1981

[54] CONTACTLESS IGNITION SYSTEM FOR INTERNAL COMBUSTION ENGINES

[75] Inventors: Shinro Torii, Chiryu; Toshio Tanaka, Anjo; Kouichi Sasaki, Kariya; Tsuneo Kato, Kariya; Shigeya Abe, Kariya, all of Japan

[73] Assignee: Nippondenso Co., Ltd., Kariya, Japan

[21] Appl. No.: 33,151

[22] Filed: Apr. 24, 1979

[30] Foreign Application Priority Data

Jun. 23, 1978 [JP] Japan ..... 53/76777

[51] Int. Cl.[3] ..... F02P 1/00; F02P 5/04

[52] U.S. Cl. ..... 123/651; 123/146.5 A; 315/209 T

[58] Field of Search ..... 123/148 E, 148 DC, 148 DS, 123/146.5 A, 117 R, 148 ND; 315/209 T

[56] References Cited

U.S. PATENT DOCUMENTS

| | | | |
|---|---|---|---|
| 3,521,611 | 7/1970 | Finch | 123/146.5 A |
| 4,104,997 | 8/1978 | Padgitt | 123/117 R |
| 4,112,895 | 9/1978 | Habert | 123/117 R |
| 4,150,653 | 4/1979 | Grancoin | 123/148 E |
| 4,175,507 | 11/1979 | Kawai et al. | 123/148 ND |

*Primary Examiner*—P. S. Lall

*Attorney, Agent, or Firm*—Cushman, Darby & Cushman

[57] ABSTRACT

A contactless ignition system for an internal combustion engine including an ignition signal generator having two pickup coils which are connected in series or parallel and oppositely in polarity to each other so as to be responsive to the rotation of a signal rotor in order to generate respective AC signals with one signal occurring at an intermediate position of the other, an input circuit disposed so as to be turned on or off when the AC signal from the ignition signal generator exceeds predetermined values in the positive and negative directions, respectively, an inverter circuit disposed to invert the output of the input circuit, first and second output circuits for generating a first output to turn on or off responsive to the output of the input circuit and a second output to turn off or on responsive to the output of the inverter circuit, and first and second ignition coils respectively responsive to the first and second outputs each so as to switch on and off the primary current therethrough.

10 Claims, 4 Drawing Figures

CONTACTLESS IGNITION SYSTEM FOR INTERNAL COMBUSTION ENGINES

The present invention relates to a contactless ignition system for internal combustion engines of the type employing no high tension distributor which mechanically distributes an ignition high voltage.

A contactless ignition system for internal combustion engines is known in the art, in which when the system is used with a four-cylinder, four-cycle engine, two electromagnetic pickups are arranged around the crankshaft of the engine 180 degrees apart from each other to determine the proper ignition timing and two electronic circuits (ignitors) are provided each so as to shape the output of corresponding one of the electromagnetic pickups. To apply an ignition high voltage to the respective spark plugs of the engine without the use of a high tension distributor, the electronic circuits are each connected to the primary winding of an associated one of two ignition coils, and the secondary winding of each ignition coil is connected to the associated two spark plugs. This type of contactless ignition system has a great advantage of improved durability due to the absence of any mechanical contact in the signal generating section for determining the ignition timing and in the ignition high voltage distributing section.

However, this type of known ignition system is disadvantageous in that the number of signal lines required to connect the electromagnetic pickups to the electronic circuits or ignitors is the same as the number of the electromagnetic pickups used. This is due to the fact that identical electronic circuits are provided for each of the electromagnetic pickups.

Another disadvantage is that the use of two electromagnetic pickups coils inevitably causes one of the pickups coils to be electrically interferred by the other pickups coil and consequently the resulting output waveform of one pickups coil includes an AC waveform of a relatively large amplitude required for determining the ignition timing and an interference waveform of a relatively small amplitude which is opposite in polarity and generated at an intermediate position 180 degrees out of phase in terms of the degrees of crankshaft rotation. The undesired waveform increases in proportion to the engine speed as does the required AC waveform. Thus the individual electronic circuits of each ignitor must be made so that the operating level of these circuits is changed to prevent the ignition coil from being erroneously energized and deenergized by the interference waveform so that the effect of the interference waveform is eliminated.

In accordance with the present invention there is provided a contactless ignition system for internal combustion engines comprising rotor means having at least one projection and rotated in synchronization with a crankshaft of an internal combustion engine, first pickups coil means positioned adjacent to said rotor means for generating a first output signal at every passing of said at least one projection therethrough, and second pickup coil means positioned adjacent to said rotor means for generating a second output signal at every passing of said at least one projection therethrough, said second coil means being spaced from said first coil means such that said first and second output signals are generated alternately at every half rotation of said rotor means, said system being characterized by further including connecting means for connecting said first and said second coil means oppositely in polarity such that said first and said second output signals are cumulatively added, input circuit means connected to said first and said second coil means for shaping said added output signals into a rectangular signal, inverter circuit means connected to said input circuit means for inverting said rectangular signal in polarity, a first and second ignition coils each having a primary and secondary coils, each of said secondary coils being connected to at least one spark plug provided on said internal combustion engine, first output circuit means for energizing and deenergizing said primary coil of said first ignition coil in response to said inverted rectangular signal, and second output circuit means for energizing and deenergizing said primary coil of said second ignition coil in response to said rectangular signal.

Thus in accordance with the invention, an ignition signal generator comprises a pair of pickup coils which are connected oppositely in polarity and each adapted to generate an AC signal at an intermediate position of the AC signals generated by the other pick-up coil, whereby when the resulting AC signal becomes higher than a predetermined value in the positive-going direction, primary current flows to one of the ignition coils and the primary current in the other is interrupted, and when the AC signal exceeds a predetermined value in the negative-going direction the primary current in the one ignition coil is interrupted and primary current flows to the other ignition coil, thus reducing the number of signal lines which were required in the conventional system to connect the ignition signal generator to the ignitors and causing the interference waveform of one pickup coil to cumulatively act on the AC waveform of the other pickup coil to thereby completely eliminate the ill effects of the interference waveforms.

Other objects, features and advantages of the invention will become apparent from the following detailed description, with reference being made to the accompanying drawings, in which.

The present invention will now be described in greater detail with reference to the drawings.

Figure 1:
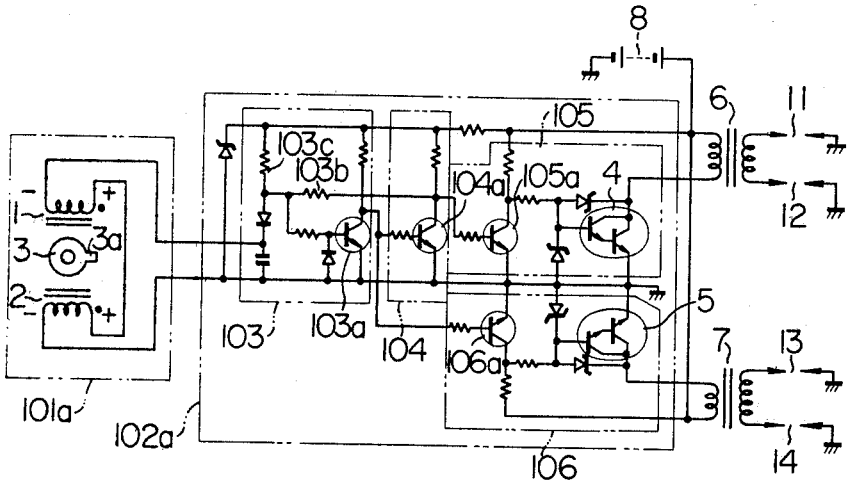
FIG. 1 is a circuit diagram showing an embodiment of a system according to the invention.
Figure 3:
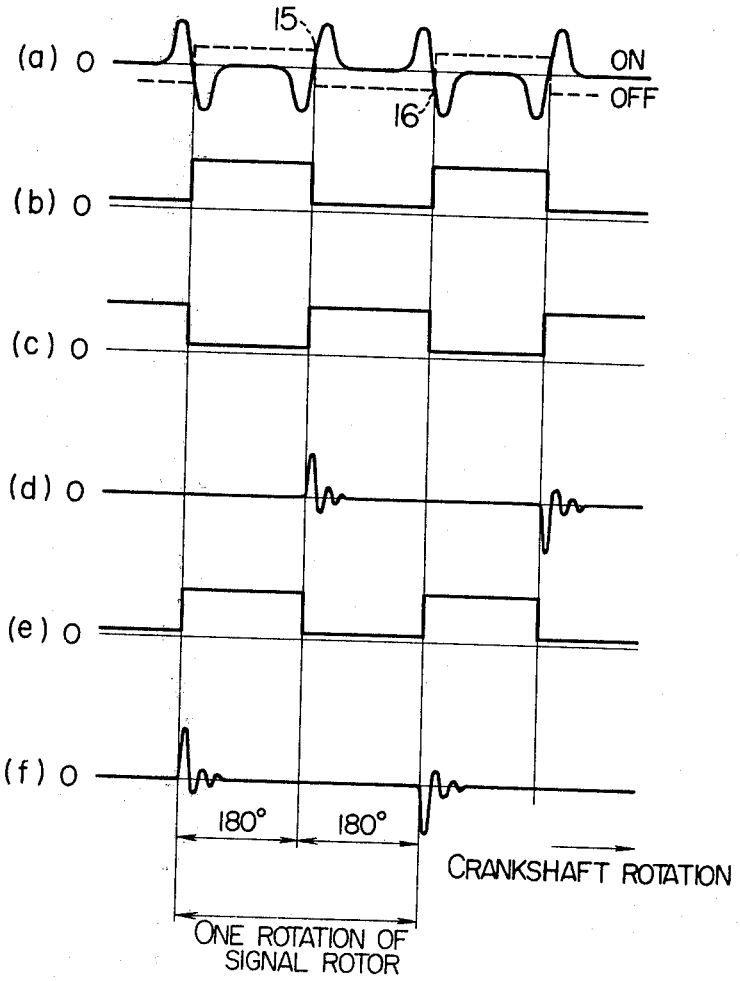
FIG. 3 is a waveform diagram useful in explaining the operation of the embodiment shown in FIG. 1.

Referring first to FIG. 1, reference numerals 1 and 2 each designate the pickup coil of an electromagnetic pickup, and reference numeral 3 a signal rotor having a projection 3*a* that rotates in synchronism with the rotation of the crankshaft of a four-cylinder, four-cycle internal combustion engine, whereby in response to every rotation of the rotor 3 the pickup coils 1 and 2 each generate one cycle of an AC signal at one of two intermediate positions which are 180 degrees apart from each other. As shown in FIG. 3 the pickup coils 1 and 2 are connected in series and are phased in opposite polarity with each other, and the pickup coils 1 and 2 and the signal rotor 3 constitute an ignition signal generator 101*a*. As is well known in the art, the pickup coils 1 and 2 are mounted 180 degrees apart on a base plate which is not shown and the position of the base plate relative to the signal rotor 3 is changed in accordance with such parameters as the engine speed, intake vacuum, etc., to thereby change the timing of signals generated from pickup coils 1 and 2.

Reference numeral 8 designates a power supply battery, reference numerals 6 and 7 designate ignition coils, and reference numerals 11, 12, 13 and 14 designate spark plugs which are respectively mounted in the engine cylinders. Reference numeral 102*a* designates an ignitor comprising an input circuit 103 connected to the pickup coils 1 and 2, an inverter circuit 104 for inverting the output of the input circuit 103, and output circuits 105 and 106. The input circuit 103 comprises an input transistor 103*a*, a positive feedback resistor 103*b* and a bias resistor 103*c*, the inverter circuit 104 comprises an inverting transistor 104*a* and the output circuits 105 and 106 respectively comprise driver transistors 105*a* and 106*a* and power transistors 4 and 5.

With the construction described above, the operation of the embodiment will now be described. The ignition signal generator 101*a* comprises the pickup coils 1 and 2 which are arranged opposite to each other on both sides of the signal rotor 3 directly coupled to the engine crankshaft and their outputs are respectively shown in (a) and (b) of FIG. 2. The output signals of the ignition signal generator 101*a* are applied to the input circuit 103 of the ignitor 102*a*. The input circuit 103 generates two kinds of outputs one of which is passed through the inverter circuit 104 to the output circuit 105 and the other of which is not passed through the inverter circuit but rather is directly supplied to the output circuit 106, and the two outputs respectively serve to control the final stage power transistors 4 and 5 of the output circuits 105 and 106, respectively. The power transistors 4 and 5 respectively interrupt the primary current in the ignition coils 6 and 7 which are each composed of a simultaneous or double ignition coil and the ignition coils 6 and 7 function in such a manner that a spark is sequentially caused at the spark plugs 11, 12, 13 and 14 in the four cylinders of the engine without using high voltage distribution mechanism.

Figure 2:
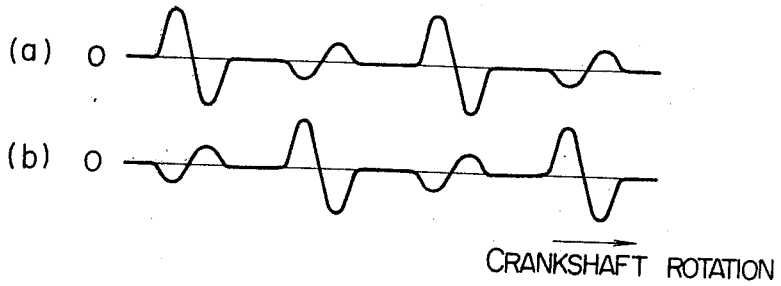
FIG. 2 is a waveform diagram showing output signals of the signal generator shown in FIG. 1.

The operation of the system shown in FIG. 1 will now be described with reference to FIGS. 2 and 3 showing the timing of operation of the system. The solid line in (a) of FIG. 3 shows the output signal of the ignition signal generator 101*a*. The broken line in the same (a) shows the operating level of the input circuit 103 of the ignitor 102*a*, indicating that the circuit has its on and off operating points on the positive-going and negative-going sides of the waveform and they are preset to produce a hysteresis effect. These operating points can be preset as desired by selecting the resistance values of the resistors 103*b* and 103*c*. Referring to (b) of FIG. 3 showing the collector voltage waveform of the input transistor 103*a*, the waveform shows that the input transistor 103*a* is turned on at an operating point 15 on the positive-going portion of the waveform and the transistor 103*a* is turned off at an operating point 16 on the negative-going portion of the waveform. Consequently the power transistor 4 is turned off at the operating point 15 and the power transistor 5 is turned off at the operating point 16, thus respectively generating a high voltage in the secondary winding of the ignition coils 6 and 7, respectively. In other words, even with the single input circuit of the ignitor 102*a*, it is possible to effect the selection of the cylinders or to select one or the other of the ignition coils in which a high voltage is to be produced in the secondary winding. In connection with the two outputs of the input circuit 103*a*, shown in (c) of FIG. 3 is the collector voltage waveform of the power transistor 4 adapted for switching through the inverter circuit 104 and the corresponding secondary voltage waveform of the ignition coil 6 is shown in (d) of FIG. 3. On the other hand, shown in (e) of FIG. 3 is the collector voltage waveform of the power transistor 5 adapted for switching not through the inverter circuit 104 and the corresponding secondary voltage waveform of the ignition coil 7 is shown in (f) of FIG. 3. Namely, in the indication of the waveforms (d) and (f) of FIG. 3, the right waveforms of these Figures respectively indicate voltage waveforms applied to the spark plugs 12 and 14, and the left waveforms respectively indicate voltage waveforms applied to the spark plugs 11 and 13. For example, with respect to the cylinder of the spark plug 11 undergoing compression stroke the cylinder of the spark plug 12 undergoes exhaust stroke with low inner pressure, accordingly the spark plug 12 assumes a short-circuited condition to the ground. On the contrary, with respect to the cylinder of the spark plug 12 undergoing compression stroke the cylinder of the spark plug 11 undergoes exhaust stroke, accordingly the spark plug 11 assumes a short-circuited condition to the ground and the negative voltage is applied to the spark plug 12. It will thus be seen that the ignition coils 6 and 7 alternately generate an ignition high voltage each for every half rotation of the signal rotor 3. With the four-cylinder engine in which the air-fuel mixture is fired in the order of the first, third, fourth and second cylinders, by mounting the spark plugs 11, 12, 13 and 14 respectively in the first, third, fourth and second cylinders, it is possible to distribute an ignition high voltage to the respective cylinders and to make the respective air-fuel mixtures fire according to the firing order without any mechanical high voltage distributing mechanism.

In this case, due to the fact that the ignition signal generator 101*a* comprises the pickup coils 1 and 2 which are connected oppositely in polarity, as shown in (a) of FIG. 3, the output signal of the ignition signal generator 101*a* has a waveform composed of the AC signals which are opposite in polarity and generated from the pick-up coils 1 and 2, with the result that an interference waveform of opposite polarity which is generated from one of the pick-up coils 1 and 2 at an intermediate position between its output AC signals acts cumulatively on the AC signal generated from the other pick-up coil and any ill effect due to the interference waveform is eliminated.

Figure 4:
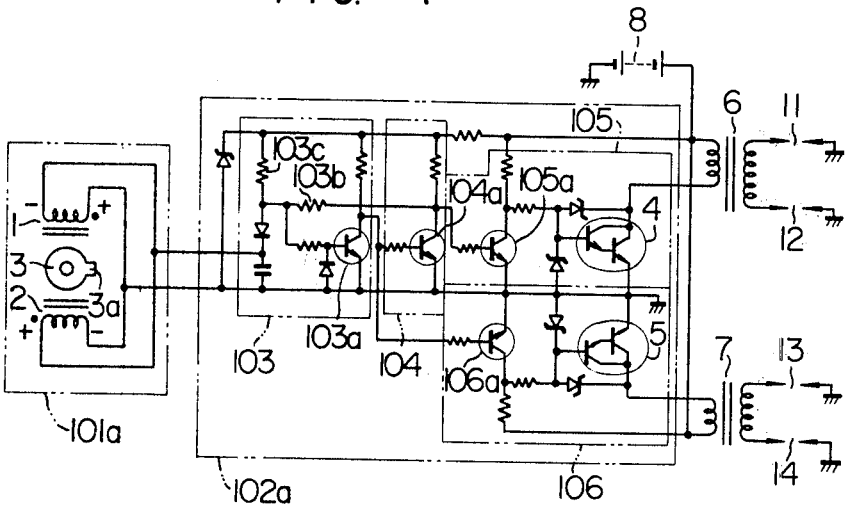
FIG. 4 is a circuit diagram showing another 6embodiment of the invention.

FIG. 4 shows another embodiment of the system of this invention in which the same reference numerals as used in FIG. 1 designate the same component parts. This embodiment differs from the embodiment of FIG. 1 in that the pickup coils 1 and 2 are connected in parallel and not in series, and its operation is the same with that of the embodiment of FIG. 1. As compared with the embodiment of FIG. 1, the parallel connection of the pickup coils 1 and 2 has the effect of decreasing the inductance of the ignition signal generator 101*a* and thereby reducing the delay of the ignition timing due to the inductance during high speed operation of the engine.

While, in the embodiments described above, each of the ignition coils 1 and 2 has its secondary winding connected to two spark plugs so as to operate a four-cylinder engine, the embodiments may be used in operating a two-cylinder engine by connecting one terminal of the secondary windings of the ingition coils 6 and 7 to the ground and connecting only the other terminal of the secondary windings to the respective spark plugs.

These embodiments may also be used in operating a four-cylinder internal combustion engine by providing the signal rotor 3 with two projections arranged at equal spaces of 180 degress, arranging the pick-up coils 1 and 2 angularly apart by 90 degrees, causing the pickup coils 1 and 2 alternately to generate AC signals at 180 degrees intervals for every rotation of the signal rotor 3, rotating the signal rotor 3 at one-half the speed of the engine crankshaft, and connecting the secondary winding of the ignition coils 6 and 7, respectively, to the associated two spark plugs.

It will thus be seen that by virtue of the vact that an ignition signal generator comprises two pickup coils connected oppositely in polarity with each one arranged so as to generate an AC signal at an intermediary position of the AC signals generated by the other and there is provided an ignitor so that when the resultant AC signal from the ignition signal generator exceeds a predetermined value in the positive-going direction, primary current flows to one of the ignition coils and the primary current in the other ignition coil is interrupted and when the AC signal exceeds a predetermined value in the negative-going direction the primary current in the one ignition coil is interrupted and primary current flows to the other ignition coil. Thus the present invention has the following advantages.

(1) The number of groups of signal wires leading from the ignition signal generator to the ignitor is reduced from 2 to 1.

(2) With the number of the input circuits in the ignitor reduced to 1 the invention is more simply constructed.

(3) No special signals or means are required for the proper selection of the cylinders.

(4) Practically interference signals needs not be taken into consideration for the input circuit of the ignitor.

(5) The angle of closing of each ignition coil can be maintained practically at a constant value despite any variations in the operating level by different ignitor input circuits due to the manufacturing process.

What is claimed is:

1. A contactless ignition system for an internal combustion engine comprising:

rotor means having at least one projection and adapted to be rotated in synchronization with a crankshaft of said internal combustion engine;

first pickup coil means positioned adjacent to said rotor means for generating a first output signal at every passing thereby of said at least one projection;

second pickup coil means positioned adjacent to said rotor means for generating a second output signal at every passing thereby of said at least one projection, said second coil means being spaced from said first coil means such that each of said first and said second output signals is generated substantially at every half rotation of said rotor means;

connecting means for connecting said first and said second pickup coil means in parallel and opposite in polarity such that said first and said second output signals are cumulatively added to form a synthesized output signal;

input circuit means coupled to said connecting means via a single pair of wires and adapted to receive said synthesized output signal for providing a generally rectangular shaped signal the leading and trailing edges of which are triggered by the comparison of said synthesized signal with preset threshold levels;

inverter circuit means connected to said input circuit means for inverting said rectangular signal in polarity to form an inverted rectangular signal;

first and second ignition coils each having a primary and a secondary coil, each of said secondary coils adapted to be connected to at least one spark plug provided on said internal combustion engine;

first output circuit means, coupled to said inverter circuit means for energizing and deenergizing said primary coil of said first ignition coil in response to said inverted rectangular signal; and second output circuit means, coupled to said input circuit means, for energizing and deenergizing said primary coil of said second ignition coil in response to said rectangular signal.

2. A contactless ignition system for an internal combustion engine comprising:

rotor means having at least one projection and adapted to be rotated in synchronization with a crankshaft of said internal combustion engine;

first pickup coil means positioned adjacent to said rotor means for generating a first output signal at every passing thereby of said at least one projection;

second pickup coil means positioned adjacent to said rotor means for generating a second output signal at every passing thereby of said at least one projection, said first and second pickup coil means being disposed 180° apart from each other about said rotor means, and producing first and second output signals alternately at every half rotation of said rotor means;

connecting means for connecting said first and second pickup coil means in parallel and opposite in polarity such that said first and second output signals are cumulatively added to form an added output signal;

input circuit means, coupled to said connecting means, for shaping said added output signal into a rectangular signal, said input circuit means comprising a waveform which is enabled or disabled in response to said added output signal exceeding a predetermined value in a positive-going direction and which is disabled or enabled in response to said added output signal exceeding a predetermined value in a negative-going direction;

inverter circuit means connected to said input circuit means for inverting said rectangular signal in polarity to form an inverted output signal;

first and second ignition coils, each having a primary and a secondary coil, said secondary coil of each of said first and second ignition coils having two terminals adapted to be connected to spark plugs of said internal combustion engine;

first output circuit means, coupled to said inverter circuit means for energizing and deenergizing said primary coil of said first ignition coil in response to said inverted rectangular signal; and second output circuit means, coupled to said input circuit means, for energizing and deenergizing said primary coil of said second ignition coil in response to said rectangular signal.

3. A contactless ignition system for an internal combustion engine comprising:

rotor means having at least one projection and adapted to be rotated in synchronization with a crankshaft of said internal combustion engine;

first pickup coil means positioned adjacent to said rotor means for generating a first output signal at every passing thereby of said at least one projection;

second pickup coil means positioned adjacent to said rotor means and 180° around said rotor means with respect to said first pickup coil means for generating a second output signal at every passing thereby of said at least one projection, said second coil means being spaced from said first coil means such that said first and said second output signals are generated alternatively at every half rotation of said rotor means;

connecting means for connecting said first and said second coil means oppositely in polarity such that said first and said second output signals are cumulatively added to form a synthesized signal;

input circuit means, connected to said connecting means via a single pair of wires, for shaping said synthesized into a rectangular signal, said input circuit means comprising a waveform shaping circuit which is enabled or disabled in response to the synthesized signal exceeding a predetermined value in a positive-going direction and which is disabled or enabled in response to the synthesized signal exceeding a predetermined value in a negative-going direction;

inverter circuit means connected to said input circuit means for inverting said rectangular signal in polarity to form an inverted rectangular signal;

first and second ignition coils each having a primary and secondary coils, each of said secondary coils having two terminals adapted to be connected to a spark plug;

first output circuit means for energizing and deenergizing said primary coil of said first ignition coil in response to said inverted rectangular signal; and second output circuit means for energizing and deenergizing said primary coil of said second ignition coil in response to said rectangular signal.

4. A contactless ignition system for an internal combustion engine comprising:

rotor means having at least one projection and adapted to be rotated in synchronization with a crankshaft of said internal combustion engine;

first pickup coil means positioned adjacent to said rotor means for generating a first output signal at every passing thereby of said at least one projection;

second pickup coil means positioned adjacent to said rotor means and 180° around said rotor means with respect to said first pickup coil means for generating a second output signal at every passing thereby of said at least one projection, said second coil means being spaced from said first coil means such that said first and said second output signals are generated alternately at every half rotation of said rotor means;

connecting means for connecting said first and second coil means in series and oppositely in polarity such that said first and said second output signals are cumulatively added to form a synthesized signal;

input circuit means connected to said connecting means via a single pair of wires for shaping said synthesized output signals into a rectangular signal, said input circuit means comprising a waveform shaping circuit which is enabled or disabled in response to the added signal exceeding a predetermined value in a positive-going direction and which is disabled or enabled in response to the added signal according to a predetermined value in a negative-going direction;

inverter circuit means connected to said input circuit means for inverting said rectangular signal in polarity to form an inverted rectangular signal;

a first and second ignition coils each having a primary and secondary coils, each of said secondary coils having two terminals adapted to be connected to a spark plug;

first output circuit means for energizing and deenergizing said primary coil of said first ignition coil in response to said inverted rectangular signal; and second output circuit means for energizing and deenergizing said primary coil of said second ignition coil in response to said rectangular signal.

5. A contactless ignition system for an internal combustion engine comprising:

rotor means having at least one projection and adapted to be rotated in synchronization with a crankshaft of said internal combustion engine;

first pickup coil means positioned adjacent to said rotor means for generating a first output signal at every passing thereby of said at least one projection;

second pickup coil means positioned adjacent to said rotor means and 180° around said rotor means with respect to said first pickup coil means for generating a second output signal at every passing thereby of said at least one projection, said second coil means being spaced from said first coil means such that said first and said second output signals are generated alternately at every half rotation of said rotor means;

connecting means for connecting said first and second coil means in parallel and oppositely in polarity such that said first and said second output signals are cumulatively added to form a synthesized signal;

input circuit means connected to said connecting means via a single pair of wires for shaping said synthesized signal into a rectangular signal, said input circuit means comprising a waveform shaping circuit which is enabled or disabled in response to the synthesized signal exceeding a predetermined value in a positive-going direction and which is disabled or enabled in response to the added signal according to a predetermined value in a negative-going direction;

inverter circuit means connected to said input circuit means for inverting said rectangular signal in polarity the form an inverted rectangular signal;

a first and second ignition coils each having a primary and secondary coils, each of said secondary coils having two terminals, each such terminal for connection to a spark plug;

first output circuit means for energizing and deenergizing said primary coil of said first ignition coil in response to said inverted rectangular signal; and second output circuit means for energizing and deenergizing said primary coil of said second ignition coil in response to said rectangular signal.

6. A contactless ignition system for an internal combustion engine comprising:

rotor means having at least one projection and adapted to be rotated in synchronization with a crankshaft of said internal combustion engine;

a first pickup coil positioned adjacent to said rotor means for generating a first alternating current signal at every passing thereby of said at least one projection;

a second pickup coil positioned adjacent to said rotor means for generating a second alternating current signal at every passing thereby of said at least one projection, said second coil being spaced from said first pickup coil such that said first and second alternating current signals have a predetermined phase shift with respect to one another;

connecting means for coupling said first and second pickup coils in series and with opposite polarity such that said first and second alternating current signals are cumulatively added to form an added alternating current signal;

first circuit means for receiving said added alternating current signal from said connecting means via a single pair of wires and producing a first rectangular signal synchronized with said added alternating current signal the leading and trailing edges of said first rectangular signal being triggered by the comparison of said added alternating current signal with present threshold levels;

second circuit means coupled to said first circuit means for producing a second rectangular signal opposite in polarity to said first rectangular signal; and first and second ignition coils each having a primary and secondary winding, said primary windings of said first and second ignition coils being controlled by said first and second rectangular signals, respectively, and said secondary windings adapted to provide ignition power for said internal combustion engine.

7. A contactless ignition system for an internal combustion engine comprising:

rotor means having at least one projection and adapted to be rotated in synchronization with a crankshaft of said internal combustion engine;

a sub-assembly including:

a first pickup coil positioned adjacent to said rotor means for generating a first alternating current signal at every passing thereby of said at least one projection;

a second pickup coil positioned adjacent to said rotor means for generating a second alternating current signal at every passing thereby of said at least one projection, said second pickup coil being spaced from said first pickup coil such that said first and second alternating current signals have a predetermined phase shift with respect to one another;

connecting means for coupling said first and second pickup coils in parallel and oppositely in polarity such that said first and second alternating current signals are cumulatively added to form an added alternating current signal;

first circuit means for receiving said added alternating current signal from said connecting means of said sub-assembly via a single pair of wires and producing a first rectangular signal synchronized with said added alternating current signal;

second circuit means coupled to said first circuit means, for receiving said added alternating current signal and producing a second rectangular signal opposite to said first rectangular signal in polarity; and a first and second ignition coils each having a primary and secondary winding, said primary windings of said first and second ignition coils being controlled by said first and second rectangular signals, respectively and said secondary windings adapted to provide ignition power for said internal combustion engine.

8. A contactless ignition system for an internal combustion engine comprising:

a rotor adapted to be coupled to the crankshaft of said engine so as to rotate therewith, said rotor having a rotor portion for inducing a signal in a pickup;

first pickup coil means positioned with respect to said rotor such that a first signal is induced therein by the passage thereby of said rotor portion;

second pickup coil means positioned with respect to said rotor such that a second signal having a predetermined phase shift with respect to said first signal is induced therein by the passage thereby of said rotor portion, said first and second signals each having a spurious component;

means for coupling said first and second pickup coil means in opposite polarity to provide a cumulative output signal;

first circuit means, coupled to said coupling means via a single pair of wires, for receiving said cumulative output signal and providing a first rectangular signal synchronized with said cumulative output signal;

second circuit means, coupled to said first circuit means, for providing a second rectangular signal opposite in polarity to said first rectangular signal; and first and second ignition coils each having a primary and secondary winding, said primary windings of said first and second ignition coils being controlled by said first and second rectangular signals, respectively, and said secondary windings being adapted to provide ignition power for said internal combustion engine.

9. A contactless ignition system according to claim 8 wherein said coupling means couples said first and second coils in series and in opposite polarity.

10. A contactless ignition system according to claim 8 wherein said coupling means couples said first and second coils in parallel and in opposite polarity.

* * * * *